US005259379A

United States Patent [19]

Kim et al.

[11] Patent Number: 5,259,379

[45] Date of Patent: * Nov. 9, 1993

[54] THERAPEUTIC, PORTABLE FOLDING CHAIR PROVIDED WITH A WATER HEATING SYSTEM

[76] Inventors: Yong Hak Kim; Soon Ja Kim, both of 330 S. Parrish St., Baltimore, Md. 21223

[ * ] Notice: The portion of the term of this patent subsequent to Sep. 15, 2009 has been disclaimed.

[21] Appl. No.: 864,854

[22] Filed: Apr. 7, 1992

[51] Int. Cl.[5] ..... A47C 21/00; A01F 7/00

[52] U.S. Cl. ..... 607/104; 5/421

[58] Field of Search ..... 128/376, 377; 5/422, 5/421, 284

[56] References Cited

U.S. PATENT DOCUMENTS

| | | | |
|---|---|---|---|
| 333,820 | 1/1886 | Bowman | 5/422 |
| 385,865 | 7/1888 | Lewis | 5/422 |
| 665,243 | 1/1901 | Carla | 5/422 |
| 697,279 | 4/1902 | Schmid | 5/421 |
| 1,121,277 | 12/1914 | Mitchell . | |
| 1,212,479 | 1/1917 | Hall | 5/421 |
| 1,575,871 | 3/1926 | Stlar | 128/376 |
| 4,114,620 | 9/1978 | Moore et al. . | |
| 4,218,791 | 8/1980 | Itotu | 5/284 |
| 4,663,516 | 5/1987 | Blum | 5/421 |

*Primary Examiner*—Mark S. Graham

*Attorney, Agent, or Firm*—Birch, Stewart, Kolasch & Birch

[57] ABSTRACT

A therapeutic, portable folding chair provided with a heating system, which includes a base member, a serpentine water pipe, a hollow top portion of the back which functions as a water tank, a water heater attached to and disposed within the base member, and a mugwort herb pad disposed on the base member, whereby the folding chair can be easily moved and a vapor generated from the pad heated by the water pipe through the water heater warms and treats the human body sitting thereon or lying on a bed converted from the folding chair.

14 Claims, 2 Drawing Sheets

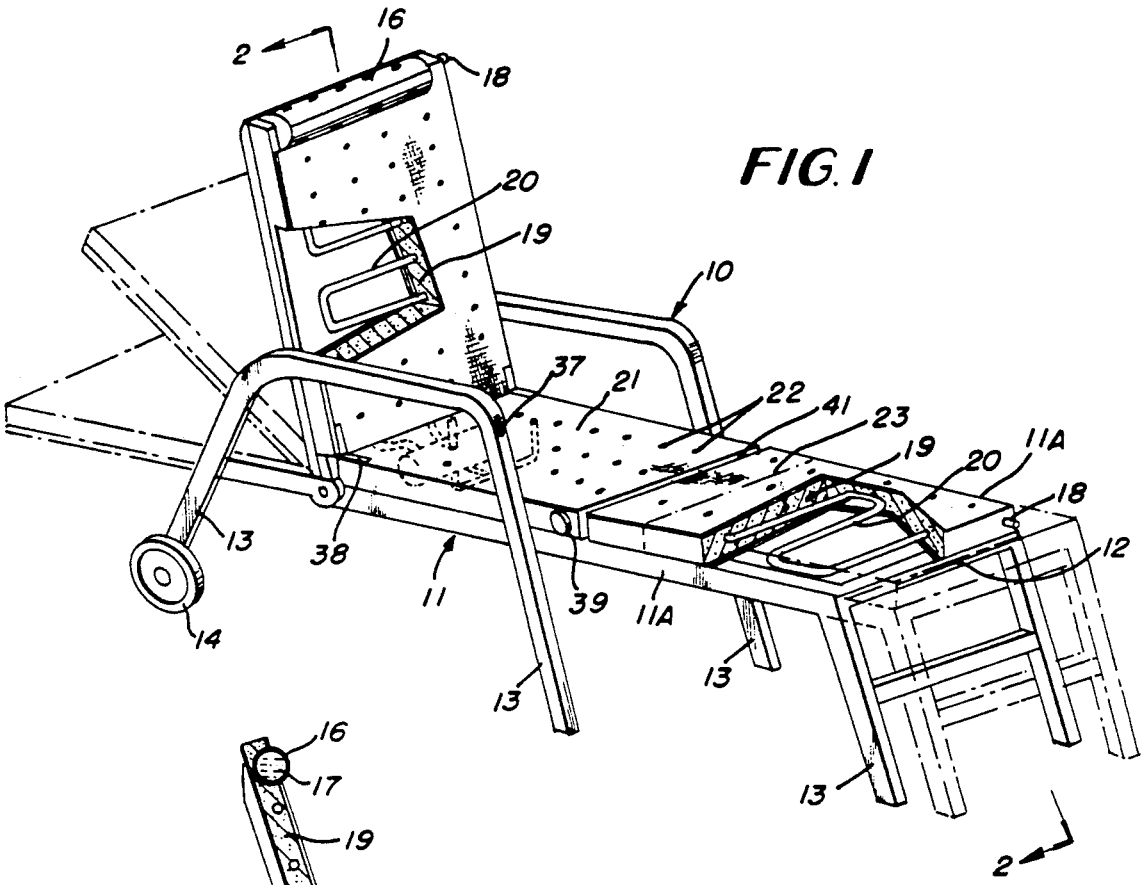
FIG. 1
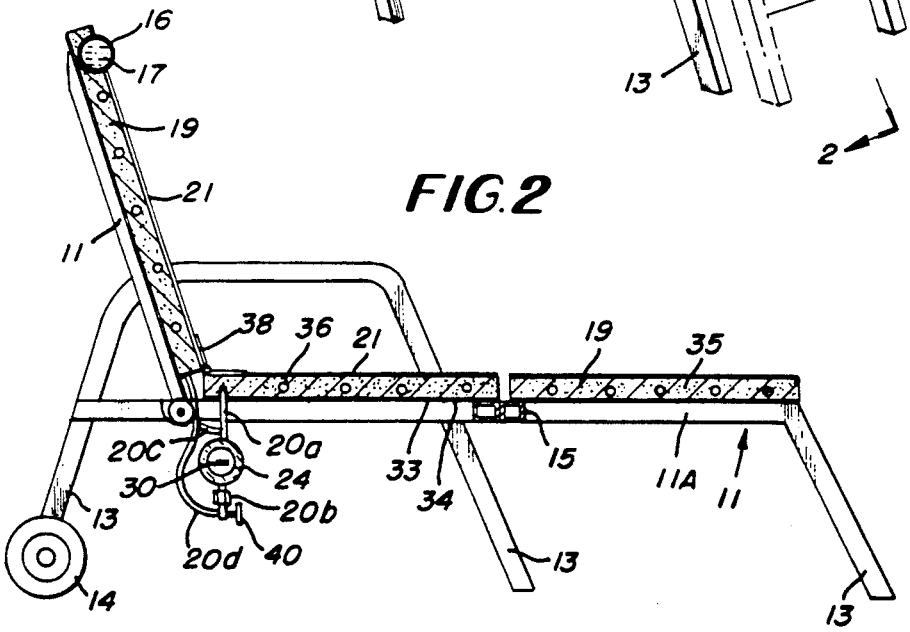
FIG. 2
FIG. 3
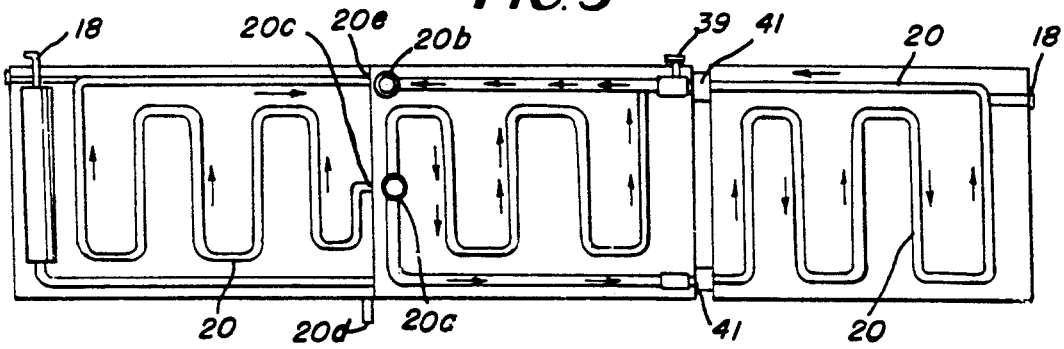

THERAPEUTIC, PORTABLE FOLDING CHAIR PROVIDED WITH A WATER HEATING SYSTEM

BACKGROUND OF THE INVENTION

2. Field of the Invention

The present invention relates to a therapeutic, portable chair provided with a heating system and more particularly, to a portable water heated folding chair including a base member, a serpentine configured water pipe extending through the base member, and a water heater, whereby the portable water heated folding chair can heat a person sitting on a padded seat and a padded back of the folding chair or a person lying on a pad on a bed converted from the folding chair by circulating hot water in the water pipe through the water heater attached to and disposed within the base bed member.

2. Description of the Prior Art

Various types of water heated beds are known in the art. Such prior art water heated beds include a separate water heating system and a water pipe disposed in the bed, which communicates with the water heating system as shown in U.S. Pat. No. 333,820 to Bowman and U.S. Pat. No. 1,121,277 to Mitchell.

Also, various types of water heated pads are known in the art. Such prior art water heated pads include a water tube disposed therein and a separate or composite electric heater for heating the water disposed in the water tube buried in the pad as shown in U.S. Pat. No. 692,279 to Schmied and U.S. Pat. No. 4,114,620 to Moore et al.

However, such prior art devices suffer from a number of problems such as, for example, (a) problems with regard to moving the bed and the separate heating system, (b) problems associated with the complicated structure which includes a separate water tank, a separate heater, etc., and (c) problems with regard to achieving an effective treatment for the human body.

The present inventors have also filed U.S. patent application Ser. No. 07/782,229, filed Nov. 4, 1991, now U.S. Pat. No. 5,146,633 which is related to the present application and discloses a therapeutic, portable bed including an electric water heating system attached to and disposed within a base member of the bed, a hollow headboard of the bed, which functions as a water tank, a serpentine configured water pipe extending through a concrete plate of the base member, and a cotton pad member containing mugwort herb, disposed on a laminated paper cover on the concrete plate, whereby the chair can be easily moved and a vapor from the cotton pad can warm and treat the human body lying on the bed.

SUMMARY OF THE INVENTION

Accordingly, it is an object of the present invention to provide an improved therapeutic, portable water heated chair for heating a person lying on the chair, which eliminates the above problems encountered with conventional heating chairs.

Another object of the present invention is to provide a therapeutic, portable folding chair including a base member, a serpentine configured water pipe extending through the base member, a hollow top portion of the back which functions as a water tank, a water heater attached to and disposed within the base member, and a pad containing mugwort herb or other pharmaceutical ingredients, whereby when a plug of the water heater is connected to a power source, the hot water is easily circulated within the water pipe and a vapor generated from the pad penetrates and treats a desired region of the human body sitting on the folding chair or lying on the bed converted from the folding chair.

A further object of the present invention is to provide a therapeutic, portable folding chair which is simple in structure, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a therapeutic, portable folding chair provided with a heating system, which includes a base member, a serpentine water pipe, a hollow top portion of the back which functions as a water tank, a water heater attached to and disposed within the base member, and a mugwort herb or other pharmaceutical pad disposed on the base member, whereby the folding chair can be easily moved and a vapor generated from the pad heated by the water pipe through the water heater warms and treats the human body sitting thereon or lying on a bed converted from the folding chair.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of the therapeutic, portable chair having a water heating system containing cut-away portions in order to illustrate the construction of the folding chair according to the present invention;

FIG. 2 is a sectional view of FIG. 1, taken along line 2-2;

FIG. 3 is top plan view of a water pipe extending through the base member of a bed converted from the folding chair.

DESCRIPTION OF THE PREFERRED EMBODIMENTS

Figure 4:
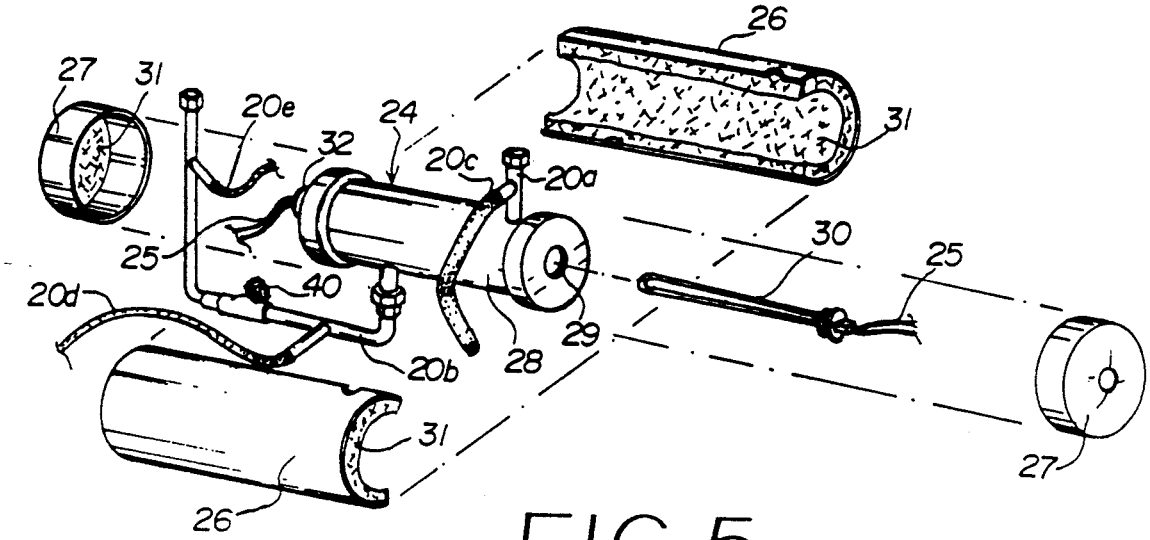
FIG. 4 is a exploded perspective view of a water heater of the water heated bed according to the present invention.

Referring now in detail to the drawings for the purpose of illustrating preferred embodiments of the present invention, the therapeutic, portable folding chair 10 as shown in FIGS. 1 and 2, comprises a base member 11 including a back part, a seat part, foot posts, a pair of longitudinal frames 11A, a plurality of transverse frames 12, a plurality of legs 13 at least one pair of legs having rollers 14 mounted thereon. There is further provided a plate member supported by the base member 11 and including a back part, a seat part, and foot posts. A serpentine configured water pipe 20 extends through a concrete plate 19 disposed on the base member 11, a water heater 24 is attached to and disposed within the base member 11, and a hollow top portion 16 of the top of the back part of the base member 11 is provided as a water tank with water 17. The water pipe 20 may be buried in a metallic wire net 35 in the concrete plate 19.

As shown in FIGS. 2 and 3, a base plate or bottom support member 33 is disposed on the base member 11 and an insulating plate 34 made of Styrofoam TM is disposed on the base plate 33. Thereafter, the serpentine configured water pipe 20 is put on the insulating plate 34 and buried with the metallic wire net 35. And then concrete is put on there for burying the water pipe 20 and the wire net 35 to produce the concrete plate 19 and a laminated paper floor 36 attached on the concrete plate 19. The back part connected to the seat part by a hinge 38 is foldable to the seat part in a conventional manner to become a regular chair. The foot posts can be separated from the seat part or locked to the seat part by a pair of locking or releasing members 15. One pair of arm supports extending from legs 13 has an on/off switch 37 attached on the arm support.

As shown in FIGS. 1 and 2, a separate cotton pad 21 adapted to contain mugwort herb (*Artemisian vulgaris*) 23 or other pharmaceutical ingredients and provided with a plurality of apertures 22 covers the laminated paper floor 36 for vaporizing the ingredients in the pad 21, whereby upon heating the concrete plate 19 and the laminated paper floor 36 by the water heater 24, the medicinal ingredients from the mugwort herb or other natural or pharmaceutical substance of the pad 21 are evaporated by the heat and may penetrate and treat any desired portion of the human body.

As shown in FIGS. 2 and 3, the water pipe 20 communicates with a cylindrical heater vessel 28 which contains an electric heater 17. In detail, the water pipe 20 disposed in the seat part of the base member 11 includes an upper outlet **20*a* which extends from a straight pipe line which also extends as a serpentine pipe 20 disposed in the foot posts by connector 41 through valve 39. The serpentine pipe line portion extends to another straight pipe line of the seat part wherein one end of the other straight pipe line has a lower water inlet 20*b* and the other end has the other valve 39. A straight pipe line of the foot posts extends to the other straight pipe line of the seat part by the other connector 41. A serpentine pipe line is connected to the water outlet 20*a* through a first rubber pipe 20*c* and extends to a straight pipe line of the back part to be connected to the water inlet 20*b* through a second rubber pipe 20*e*. Also, the other straight pipe line disposed in the back part is connected to the water inlet 20*b* through a third rubber pipe 20*d* at one end and at the other end, connected to the hollow top portion 16** as a water tank.

Figure 5:
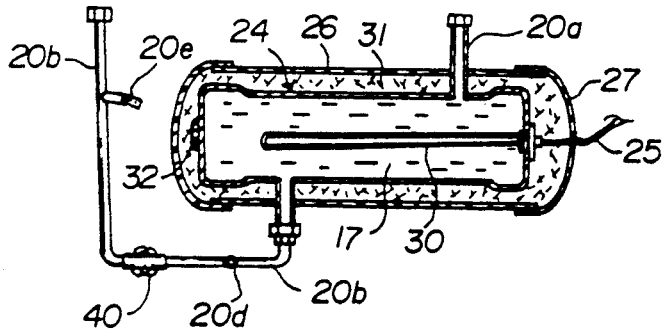
FIG. 5 is a sectional view of the assembled water heater of FIG. 3.

As shown in FIGS. 4 and 5, the water heater 24 includes a cylindrical heater vessel 28 containing water 17, the upper water outlet **20*a* and the lower water inlet 20*b*, a thermostat 32 mounted on the cylindrical heater vessel 28, and a central hole 29 for slidably receiving an electric heater 30 with a pair of electric wires 25 which is connected to the on/off switch 37. The water heater 24 is covered by a pair of semi-body covers 26 and a pair of caps 27 with each insulating material 31**.

According to the present invention, the therapeutic, portable water heating folding chair operates as follows:

Prior to use of this device, the water tank 16 is filled with water 17 as shown in FIG. 1 and the cotton pad is pre-wetted. When a plug (not shown) is connected to a power source, the pre-wetted pad is heated by the water heater 24 through the serpentine configured water pipe 20 extending through the concrete plate 19 of the base member 10. The vapor evaporates from a plurality of apertures 22 of the pad 21 so as to directly penetrate any desired region of the human body. The heat energy and pressure simultaneously act to treat the effected portion.

When the foot posts are separated from the folding chair, the folding chair is a single piece chair as shown by the dotted line foot posts of FIG. 1. Also, the back part can be laid down so as to convert the device into a bed as shown by the dotted back part of FIG. 1. Thus, the unfolded chair, that is the bed, has a water pipe arrangement as shown in FIG. 3 so that hot water 17 flows from the water outlet **20*a* and flows to the serpentine pipe line of the back part through the first rubber pipe 20*c* in the direction indicated by regular arrows to the water inlet 20*b* through the second rubber pipe 20*e*. On the other hand, the hot water 17 flows to the straight pipe line of the seat part, the serpentine pipe line of the foot posts, and both straight pipe lines of the foot posts and seat and then the water inlet 20*b* through the second rubber pipe 20*e*** in the direction indicated by the regular arrows.

When the back part is folded to the seat part and simultaneously the foot posts are removed from the chair, that is the single piece chair, the water flow in the back part is the same as the above-mentioned flow and the water flow in the seat part is in the serpentine pipe line in the direction indicated by dotted arrows to the water inlet **20*b*. Also, the therapeutic, portable folding chair of the present invention can be easily moved by using the rollers 14** and advantageously avoids adverse effects to the environment since no burning system is employed.

Thus, the water heater 24 having the electric heater 30 can warm the water 17 disposed therein and the heated water 17 can flow upward to the upper water outlet **20*a* and then the heated water 17 goes through the serpentine configured water pipe 20. Accordingly, the heated laminated paper floor 36 is heated through the heated concrete plate 19. The hot air around the heat-emitting laminated paper floor 36 heats the wet cotton pad 21. Thus the vapor from the cotton pad 21** warms the human body as well as penetrates and treats any desired region of the human body.

On the other hand, the circulated and cooled water disposed in the pipe 20 around the lower water inlet **20*b* goes into the water heater 24 through the lower water inlet 20*b*. Accordingly, the cooled water 17 can circulate in the water pipe 20 by heating the electric heater 30** again.

Furthermore, the water tank 16 extending through the hollow top portion 16 is provided with the security valve 18 disposed on the upper side portion of the water tank 16 so that the water tank 16 is protected from explosion due to the accumulation of excess temperature or pressure in the water tank 16 and may be connected to a water supply line. Also, the security valve 18 is disposed at the end of the water pipe line.

Figure 6:
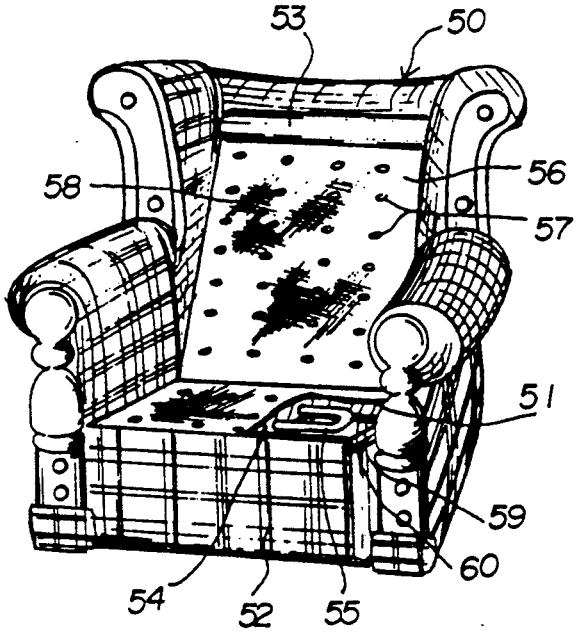
FIG. 6 is a perspective view of an additional embodiment of the chair according to the present invention.

Referring in detail to FIG. 6, there is illustrated an additional embodiment of a one piece regular chair 50 in accordance with the present invention. The chair 50 includes frames 52, a hollow top portion 53 which functions as a water tank, a base member containing a support plate 59, an insulating plate 60, a concrete plate 54 containing water pipe 55, and a laminated paper floor 51, and a cotton pad 56 containing a pharmaceutical substance or mugwort herb (*Artemisian vulgaris*) 58 and a plurality of apertures 57, whereby the vapor evaporated from the plurality of apertures 57 of the pad 55 or the pad 55 can directly penetrate any desired region of the human body.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A therapeutic, portable folding chair provided with a water heating system comprising:

a base member including a back part, a seat part, and foot posts, each part of said base member having a bottom support member, an insulating plate disposed on said bottom support member, a concrete plate and a laminated paper cover disposed in sequence on said insulating plate;

a pair of longitudinal frames and a plurality of transverse frames provided in said base member, said longitudinal frames and said transverse frames defining a chair support for said insulating plate, said concrete plate, and said laminated cover;

a serpentine configured water pipe extending through said concrete plate of said seat part;

a serpentine configured water pipe extending through said concrete plate of said back part; and means for connecting said serpentine configured water pipe of said back part with said serpentine configured water pipe of said heat part;

a hollow top portion of the back part of the folding chair, which functions as a water tank, said hollow top portion communicating with said serpentine configured water pipe;

an electric water heater attached to and disposed beneath said base member, said electric water heater communicating with said serpentine configured water pipe, said electric water heater including a cylindrical heater vessel adapted to contain water and to slidably receive an electric heater therewithin and a water heater cover defining a pair of semi-vessel covers and a pair of caps for covering the cylindrical heater vessel therewithin; and a cotton pad member containing mugwort herb *Artemisian vulgaris,* and disposed on said laminated paper cover, whereby the folding chair can be easily moved and a vapor from the cotton pad can warm and heat a human body sitting on the folding chair and lying on a bed converted from the folding chair.

2. The therapeutic, portable folding chair of claim 1, wherein said serpentine configured water pipe is buried in said concrete plate with a steel wire net.

3. The therapeutic, portable folding chair of claim 1, wherein said serpentine configured water pipe of said seat part has a pair of connectors at connecting portions thereof disposed between said seat part and said foot posts.

4. The therapeutic, portable folding chair of claim 3, wherein said serpentine configured water pipe of said seat part has a pair of valves in the vicinity of said connectors.

5. The therapeutic, portable folding chair of claim 1, wherein said hollow top portion as a water tank is provided with a security valve disposed on an upper side wall thereof.

6. The therapeutic, portable folding chair of claim 5, wherein said security valve is used as a water supply inlet.

7. The therapeutic, portable folding chair of claim 1, wherein said water heater cover includes an insulating material disposed therein.

8. A therapeutic, portable chair having a water heating system comprising:

a base member including a back part and a seat part, said base member having a bottom support member, an insulating plate disposed on said bottom support member, a concrete plate and a laminated paper cover disposed in sequence on said insulating plate;

a pair of longitudinal frames and a plurality of transverse frames provided in said base member, said longitudinal frames and said transverse frames defining a chair support for said insulating plate, said concrete plate, and said laminated cover;

a serpentine configured water pipe extending through said concrete plate of said seat part and of said back part;

means for connecting portions of said serpentine configured water pipe of said back part with said serpentine configured water pipe of said seat part;

a hollow top portion of the back part of the folding chair, which functions as a water tank, said hollow top portion communicating with said serpentine configured water pipe;

an electric water heater attached to and disposed beneath said base member, said electric water heater communicating with said serpentine configured water pipe, said electric water heater including a cylindrical heater vessel adapted to contain water and to slidably receive an electric heater therewithin and a water heater cover defining a pair of semi-vessel covers and a pair of caps for covering the cylindrical heater vessel therewithin; and a cotton pad member containing a mugwort herb, *Artemisian vulgaris,* and disposed on said laminated paper cover, whereby the folding chair can be easily moved and a vapor from the cotton pad can warm and treat a human body sitting on the chair.

9. The therapeutic, portable folding chair of claim 1, wherein said serpentine configured water pipe is buried in said concrete plate with a metallic wire net.

10. The therapeutic, portable folding chair of claim 8, wherein said hollow top portion as a water tank is provided with a security valve disposed on an upper side wall thereof.

11. The therapeutic, portable folding chair of claim 10, wherein said security valve is used as a water supply inlet.

12. The therapeutic, portable folding chair of claim 8, wherein said water heater cover includes an insulating material disposed therein.

13. The therapeutic, portable folding chair of claim 8, wherein said serpentine configured water pipe of said seat part has a pair of connectors at connecting portions thereof disposed between said seat part and said foot posts.

14. The therapeutic, portable folding chair of claim 13, wherein said serpentine configured water pipe of said seat part has a pair of valves in the vicinity of said connectors.

* * * * *